US005907758A

United States Patent [19]

Tanaka et al.

[11] Patent Number: 5,907,758

[45] Date of Patent: May 25, 1999

[54] ELECTROSTATIC RECORDING SYSTEM USING DIELECTRIC BELT IN WHICH ELECTRIFYING VOLTAGE IS APPLIED IN STAGES PRIOR TO IMAGE TRANSFER

[75] Inventors: Tomoaki Tanaka; Tsuneo Mizuno; Kazumi Kawabata, all of Kawasaki; Hitoshi Yoshii, Kato-gun; Teturou Nakashima, Kawasaki; Yoshimi Takizawa, Kawasaki; Kenji Fuke, Kawasaki; Eiji Suzuki, Kawasaki; Katsumi Sugimoto, Kawasaki; Katsuya Shimatsu, Kawasaki; Yasuhiro Wakabayashi, Kawasaki, all of Japan

[73] Assignee: Fujitsu Limited, Kanagawa, Japan

[21] Appl. No.: 08/891,996

[22] Filed: Jul. 14, 1997

[30] Foreign Application Priority Data

Jan. 8, 1997 [JP] Japan ..... 9-001638

[51] Int. Cl.[6] ..... G03G 15/01

[52] U.S. Cl. ..... 399/303; 399/388

[58] Field of Search ..... 399/101, 298, 399/299, 303, 310, 312, 313–315, 388; 271/193; 198/691

[56] References Cited

U.S. PATENT DOCUMENTS

| | | | |
|---|---|---|---|
| 3,642,362 | 2/1972 | Mueller | 399/312 |
| 4,162,843 | 7/1979 | Inoue et al. | 399/299 X |
| 5,113,226 | 5/1992 | Tadokoro et al. | 399/390 |
| 5,291,253 | 3/1994 | Kumasaka et al. | 399/312 X |
| 5,321,477 | 6/1994 | Nagata et al. | 399/312 |
| 5,508,879 | 4/1996 | Kitamura et al. | 399/175 X |
| 5,585,906 | 12/1996 | Takahashi et al. | 399/296 |
| 5,678,150 | 10/1997 | Takahashi et al. | 399/299 |

FOREIGN PATENT DOCUMENTS

| | | |
|---|---|---|
| 0 401 977 | 12/1990 | European Pat. Off. . |
| 3-182787 | 8/1991 | Japan . |
| 4-319456 | 11/1992 | Japan . |
| 5-249839 | 9/1993 | Japan . |
| 7-261565 | 10/1995 | Japan . |

OTHER PUBLICATIONS

European Search Report and Abstract, May 4, 1998; Appln. No. EP 97305226.

Patent Abstracts of Japan, Pub. No. 03181979, Pub. Date Jul. 8, 1991, Transfer Belt Device.

Patent Abstracts of Japan, Pub. No. 03182787, Aug. 8, 1991, Transfer Device of Image Forming Device.

Patent Abstracts of Japan, Pub. No. 02024683, Jan. 26, 1990, Image Forming Device.

European Search Report, Jul. 10, 1998, Appln. No. EP97305226.9.

*Primary Examiner*—William Royer

*Attorney, Agent, or Firm*—Armstrong, Westerman, Hattori, McLeland & Naughton

[57] ABSTRACT

An electrostatic recording system using a dielectric belt for conducting electrification of a sheet of paper and a transfer belt so that the sheet of paper is not wound and caught by a photoconductor drum, and a transfer voltage can be lowered so as to smoothly separate the sheet of paper from a transfer belt. The electrostatic recording system applies a voltage to only the dielectric belt at a stage before the sheet of paper 3 is attracted to the dielectric belt 10 and applies voltage to the sheet of paper 3 conveyed to the dielectric belt, and to the dielectric belt 10 while the sheet of paper and the belt are mutually superposed.

32 Claims, 10 Drawing Sheets

ELECTROSTATIC RECORDING SYSTEM USING DIELECTRIC BELT IN WHICH ELECTRIFYING VOLTAGE IS APPLIED IN STAGES PRIOR TO IMAGE TRANSFER

BACKGROUND OF THE INVENTION

1. Field of the Invention

This invention relates to a printer for executing printing by an electrophotographic process, and more particularly, to an electrostatic recording system using dielectric belt which can be suitably used for color printing.

2. Description of the Related Art

Electrophotographic color printing methods for printing a plurality of toner images having mutually different colors such as black, yellow, magenta and cyan, on a sheet of paper in superposition can be broadly classified into the following two kinds.

The first kind is a system or method which uses four color developing devices for one photoconductor drum or belt, develops and transfers toner images, each color one-by-one, and repeats this procedure for each color, in other words, four times in all. Transfer methods from the photoconductor drum or belt to the sheet of paper in this case include a method which transfers the toner to the sheet of paper through an intermediate transfer belt or drum. Another transfer method transfers the toner to the sheet of paper without using such an intermediate member. In either of these methods, the transfer operation must be repeated four times to one sheet of paper, and they suffer from the drawback that the printing speed drops to ¼ to that of the case where the transfer is made once. However, these transfer methods have been widely employed in the past for compact and economical electrophotographic printing apparatuses.

The second kind is a so-called "tandem" printing system or method which sequentially aligns four developing devices and four photoconductor drums for the four colors and prints the color image by the single conveying operation of the sheet of paper. Transfer of the toners from the photoconductor drums to the sheet of paper is carried out for the respective photoconductor drums while the sheet of paper passes them once, and the sheet of paper is conveyed to a fixing device after the transfer of the four colors, and the toners are thereafter fixed to the sheet of paper.

The present invention relates to a recording system which carries out conveying of the sheet of paper and transfer of the toners to the sheet of paper by using a transfer belt.

An example of a prior art method using a transfer belt is shown in FIG. 1. In FIG. 1, reference numeral 1 denotes a photoconductor drum, reference numeral 2 denotes a transfer belt, reference numeral 3 denotes a sheet of paper, reference numeral 4 denotes a corona electrifier for attraction, reference numeral 5 denotes an electrifying brush, reference numeral 6 denotes a corona electrifier and reference numeral 7 denotes an electrifier for deelectrification. The sheet of paper 3 is conveyed by the transfer belt 2. At the entrance portion to the photoconductor drum 1, both the transfer belt 2 and the sheet of paper 3 are electrified by the corona electrifier 4 disposed below the transfer belt 2 and the electrifying brush 5 disposed above the transfer belt 2, respectively, so that the sheet of paper 3 is attracted to the transfer belt 2. At the exit portion of the sheet of paper 3, the charge of the sheet of paper 3 is removed by the corona discharge from the electrifier 7 for deelectrification, and the sheet of paper 3 is separated from the transfer belt 2.

According to this method, both the sheet of paper 3 and the transfer belt 2 are inevitably electrified to the same polarity. Therefore, in order to prevent the sheet of paper 3 from being wound up by the photoconductor drum 1 and to execute the transfer of the toner from the photoconductor drum 1 to the sheet of paper 3 while the sheet of paper 3 is kept attracted to the transfer belt 2, the sheet of paper 3 must be electrified to the same polarity as that of the surface of the photoconductor drum 1.

When the surface of the photoconductor drum 1 is electrified to a negative polarity, for example, the corona electrifier 4 at the sheet entrance portion applies an electrifying voltage of a positive polarity so as to electrify the surface of the transfer belt 2 and a sheet of paper 3 to the negative charge when the voltage is applied from the back of the transfer belt 2. Therefore, the transfer voltage by the corona electrifier 6 must be elevated and consequently, the attractive force between the sheet of paper 3 and the transfer belt 2 becomes so high that, when the sheet of paper 3 is separated from the transfer belt 2, the charge of both the transfer belt 2 and the sheet of paper 3 must be removed by the electrifier 7 for deelectrification.

Because deelectrification by the electrifier 7 must be conducted by the corona discharge having an opposite polarity to that of the sheet of paper 3 and the toner, the toner on the sheet of paper 3 is attracted and scattered by the corona electrifier 7 for deelectrification, thereby lowering the image quality. Accordingly, a transfer method which can prevent the sheet of paper 3 from being wound into the photoconductor drum and can improve separability by lowering the transfer voltage has been desired.

SUMMARY OF THE INVENTION

In conjunction with electrification of the sheet of paper and the transfer belt, the present invention is directed to prevent the sheet of paper from being wound onto the photoconductor drum and to easily separate the sheet of paper from the transfer belt by lowering the transfer belt.

To accomplish the object described above, the present invention provides an electrostatic recording system using a dielectric belt, which comprises an image carrying body on the surface of which a toner image is developed, a dielectric belt for electrostatically attracting a sheet of paper, conveying the sheet of paper and bringing it into contact with the surface of the image carrying body during conveying; a transfer electrifier for applying a transfer voltage to the image carrying body from the side of the dielectric belt opposite to the image carrying body, and transferring the toner image on the surface of the image carrying body to the sheet of paper; first electrifying means for applying a voltage to only the dielectric belt at an initial stage before the sheet of paper is attracted to the dielectric belt; and second electrifying means for applying a voltage to the sheet of paper conveyed to the dielectric belt, and to the dielectric belt, while they are superposed with each other. This recording system can appropriately transfer the toner image to the sheet of paper while preventing the sheet of paper from being wound into the image carrying body such as the photoconductor drum, and can control the first and second electrifying means and the transfer electrifier so that the sheet of paper can be smoothly separated from the dielectric belt.

The electrostatic recording system of the present invention is characterized by controlling the first and second electrifying means so that the potential of the sheet of paper immediately before it passes through the transfer electrifier has the same polarity as that of the surface potential of the image carrying body. In this way, the sheet of paper is prevented from being wound into the image carrying body, such as the photoconductor drum.

When the sheet potential immediately before the sheet of paper passes through the transfer electrifier has the opposite polarity to that of the surface potential of the image carrying body, the first and second electrifying means and the transfer electrifier are controlled so that the sheet potential immediately after the passage of the sheet through the transfer electrifier has the same polarity as that of the surface potential of the image carrying body. In this way, the sheet of paper is prevented from being wound into the image carrying body such as the photoconductor drum, and transfer of the toner image to the sheet of paper can be suitably carried out.

According to the present invention, there is also provided an electrostatic recording system using a dielectric belt, which comprises a plurality of image carrying bodies on the surfaces of which toner images are developed; a dielectric belt for electrostatically attracting a sheet of paper, conveying the sheet of paper and bringing it sequentially into contact with the surfaces of a plurality of image carrying bodies during conveying; a plurality of transfer electrifiers for applying a transfer voltage to each image carrying body from the side of the dielectric belt from the side opposite to each image carrying body, and sequentially transferring the toner images on the surfaces of a plurality of image carrying bodies to the sheet of paper; first electrifying means for applying a voltage to only the dielectric belt at a stage before the sheet of paper is attracted to the dielectric belt; and second electrifying means for applying a voltage to the sheet of paper and the dielectric belt while they are superposed with each other, before the sheet of paper introduced into the dielectric belt moves to the first image carrying body.

According to this construction, transfer from each image carrying body to the sheet of paper can be carried out sequentially and appropriately without the sheet of paper being caught by each image carrying body (photoconductor drum), and the first and second electrifying means and each transfer electrifier can be controlled so that the sheet of paper can be smoothly separated from the dielectric belt after the sheet of paper passes through the last image carrying body.

The transfer electrifier corresponding to the last image carrying body is controlled in such a manner as to lower the transfer voltage at only the distal end portion of the sheet of paper when the toner image is transferred from the last image carrying body to the sheet of paper. In this way, the sheet of paper can be smoothly separated from the dielectric belt after it passes through the last image carrying body.

Four image carrying bodies are arranged in parallel to each other, so that yellow, magenta, cyan and black toners are sequentially supplied to these image carrying bodies, respectively, and the toner images of these colors are developed on the surfaces of the image carrying bodies and are sequentially transferred to the sheet of paper. Therefore, full color printing can be carried out.

When the sheet potential immediately before the sheet passing through the transfer electrifier has the same polarity as that of the surface potential of the corresponding image carrying body, or when the sheet potential of the sheet of paper immediately before it passes through the transfer electrifier has the opposite polarity to that of the surface potential of the corresponding image carrying body, the first and second electrifying means and each transfer electrifier are controlled so that the sheet potential immediately after the sheet passes through the transfer electrifier has the same potential as that of the surface potential of the image carrying body. In full color printing, therefore, transfer from one image carrying body to the sheet of paper can be carried out smoothly and sequentially without catching of the sheet by each image carrying body (photoconductor drum).

At least one of the first and second electrifying means comprises an electrifying roller. In this case, at least the surface of the electrifying roller comprises a porous body. In this way the structures of both the first and second electrifying means can be simplified.

The electrifying roller is pressed to, and brought into contact with, the dielectric belt, and freely rotates due to movement of the dielectric belt in such a manner as to follow this movement. Therefore, a driving mechanism for the electrifying roller itself is not necessary, and the construction of the driving portion can be simplified.

The first and second electrifying means comprise the electrifying rollers, and a common conductive roller, which is grounded, is disposed in such a manner as to oppose these electrifying rollers while interposing the dielectric belt between them.

At least the first electrifying means is so disposed as to come into contact with the dielectric belt. In this case, the first electrifying means comprises a rotary brush the rotating surface of which comes into contact with the dielectric belt. According to this construction, the first electrifying means not only execute electrification for attracting the sheet of paper to the dielectric belt, but also clean the dielectric belt.

Further, the peripheral speed of the rotary brush and the peripheral speed of the image carrying body are mutually different. In this case, the cleaning effect of the dielectric belt can be further improved.

The volume resistivity of the electrifying roller or the rotary brush is $10^3$ to $10^7$ ohm-cm. The volume resistivity of the dielectric belt is at least $10^{13}$ ohm-cm. In this way, electrification of the dielectric belt can be kept within a suitable range.

A rotary brush cleaner for keeping a predetermined voltage so as to remove excessive charge accumulated in the dielectric belt is disposed immediately before the position of the first electrifying means. Accordingly, the dielectric belt can be deelectrified before the dielectric belt is electrified by the first electrifying means for attracting the sheet of paper.

The rotary brush cleaner is disposed in such a manner as to come into contact with the inside surface of the dielectric belt opposite to the sheet conveying surface. According to this construction, the dielectric belt can be deelectrified without being affected by the residual toner adhering to the sheet conveying surface of the dielectric belt, or the like.

The voltage applied to the rotary brush cleaner is alternately changed for at least a predetermined time at the initial stage before the actual transfer operation is started. In this way, the dielectric belt can be cleaned, in advance, before the start of the transfer operation.

According to the present invention, there is further provided an electrostatic recording system using a dielectric belt, which comprises an image carrying body on the surface of which a toner image is developed; a dielectric belt for electrostatically attracting a sheet of paper, conveying the sheet of paper and bringing it into contact with the surface of the image carrying body during conveying; a transfer electrifier for applying a transfer voltage to the image carrying body from the side of the dielectric belt on the opposite side to the image carrying body, and transferring the toner image on the image carrying body to the sheet of paper; electrifying means for applying a voltage to the dielectric belt at a stage before the sheet of paper is attracted to the dielectric belt; and means for electrostatically attracting the sheet of paper on the dielectric belt so electrified; wherein the sheet electrostatic attraction means comprises a conductive roller which has a peripheral portion coming into contact with the surface of the sheet of paper conveyed to the dielectric belt on the opposite side to the belt and a part of which is grounded, and the absolute value of the voltage applied to the electrifying means applied to the electrifying means is greater than a discharge start voltage on the conductive roller.

Because the sheet electrostatic attraction means comprises the grounded conductive roller and the absolute value of the voltage applied to the electrifying means is higher than the discharge start voltage by this conductive roller, when the sheet of paper is conveyed to the dielectric belt, discharge is started simultaneously by the conductive roller, so that the potential of the sheet of paper can be electrified to the polarity opposite to that of the dielectric belt. Therefore, the sheet of paper is electrostatically attracted by the dielectric belt, and can be stably conveyed by a simple construction.

The conductive roller comprises a grounded conductive metal core and a flexible member disposed round the metal core and having an electric resistance. Accordingly, when the flexible member is brought into contact with the flexible member, discharge is effected from the side of the dielectric belt to the flexible member and the metal core through the sheet of paper.

The electric resistance value of the flexible member is from $10^3$ to $10^7$ ohm-cm. When the electric resistance value of the flexible member is set in this range, suitable discharge is effected through the sheet of paper, and this paper is electrified to the polarity opposite to that of the dielectric belt.

The flexible member is made of a rubber having a hardness of at least 20 degrees by JIS-A, and a frictional coefficient of 0.3 to 1.2 on the outer peripheral surface thereof. Therefore, the flexible member has suitable physical properties for electrostatically attracting the sheet of paper to the dielectric belt.

UV treatment or resin coating is applied to the flexible member so as to lower the frictional coefficient of the rubber surface. Therefore, the surface of the rubber flexible member has a suitable frictional coefficient to electrostatically attract the sheet of paper to the dielectric belt.

The flexible member may be constituted by a porous sponge is place of the rubber flexible member. In this case, the sponge preferably has physical and electrical properties similar to those of the rubber flexible member.

The electrifying means for applying the voltage to the dielectric belt is a stationary or rotary brush having a resistance value of $10^3$ to $10^7$ ohms. A felt-like dielectric belt cleaning device coming into contact with the dielectric belt can be disposed adjacent to this stationary or rotary brush. Since the brush is a rotary brush, it can be suitably rotated in the opposite direction to the sheet conveying direction of the dielectric belt.

The electrifying means for applying the voltage to the dielectric belt is made of a conductive porous material, has the shape of a roller, and rotates in the same direction as the sheet conveying direction of the dielectric belt. An A.C. voltage is applied to the electrifying means for applying the voltage to the dielectric belt, and this A.C. voltage is a sine wave or rectangular wave having a D.C. offset voltage.

The polarity of the offset voltage is opposite to the polarity of the surface potential of the image carrying body. According to this arrangement, the sheet of paper is electrified to the same polarity as that of the image carrying body, and the sheet of paper can be easily separated from the image carrying body.

DESCRIPTION OF THE PREFERRED EMBODIMENTS

Figure 1:
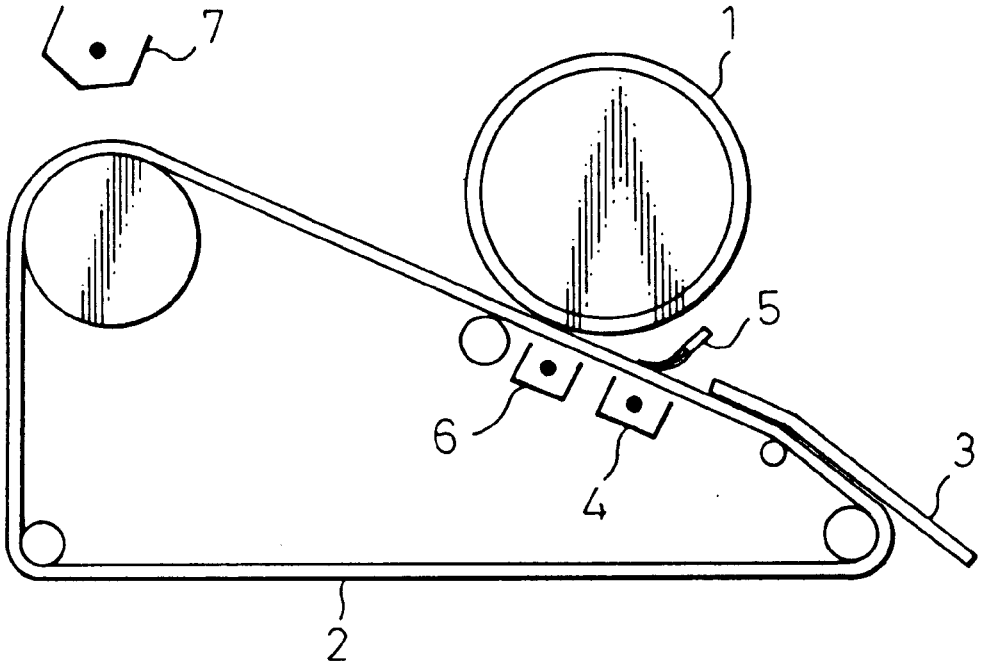
Fig.1 (PRIOR ART)
FIG. 1 is a schematic view showing a prior art example of an electrostatic electronic recording apparatus for effecting conveying and transfer of a sheet of paper by using a dielectric belt.

An example of the prior art methods using a transfer belt is shown in FIG. 1. In FIG. 1, reference numeral 1 denotes a photoconductor drum, reference numeral 2 denotes a transfer belt, reference numeral 3 denotes a sheet of paper, reference numeral 4 denotes a corona electrifier for attraction, reference numeral 5 denotes an electrifying brush, reference numeral 6 denotes a corona electrifier, and reference numeral 7 denotes an electrifier for de-electrification. The sheet of paper 3 is conveyed by the transfer belt 2. Both of the transfer belt 2 and the sheet of paper 3 are electrified by the corona electrifier 4 disposed below the transfer belt 2 and the electrifying brush 5 disposed above the corona electrifier 4, at the entrance portion to the photoconductor drum 1 so that the sheet of paper 3 can be attracted to the transfer belt 2. At the exit portion of the sheet of paper 3, on the other hand, the charge of paper 3 is eliminated by the corona discharge of the electrifier 7 for de-electrification, and the sheet of paper 3 is separated from the transfer belt 2.

According to this method, both of the sheet of paper 3 and the transfer belt 2 are inevitably electrified to the same polarity. Therefore, in order to prevent the sheet of paper 3 from being wound onto the photoconductor drum 1 and to transfer a toner from the photoconductor drum 1 to the sheet of paper 3 while the sheet of paper 3 is kept attracted to the transfer belt 2, the sheet of paper 3 must be electrified to the surface potential of the photoconductor drum 1.

When the surface of the photoconductor drum 1 is electrified to a negative polarity, for example, the corona electrifier 4 at the sheet entrance portion applies an electrifying voltage of the positive charge in the case of the application from the back of the transfer belt 2 so as to electrify the surface of the transfer belt 2 and the sheet of paper 3 to a negative charge. Therefore, the transfer voltage by the corona electrifier 6 must be increased to a high voltage, and the force of attraction between the sheet of paper 3 and the transfer belt 2 becomes so high that when the sheet of paper 3 is separated from the transfer belt 2, both of the transfer belt 2 and the sheet of paper 3 must be deelectrified by the electrifier 7 for deelectrification.

Since de-electrification by the electrifier 7 must be carried out by the corona discharge having an opposite polarity to that of the sheet of paper 3 and the toner, the toner on the sheet of paper 3 is attracted and scattered by the corona electrifier 7 for deelectrification, thereby lowering image quality. For this reason, a transfer method which prevents the sheet of paper 3 from being wound by the photoconductor drum and lowers the transfer voltage to improve separability has been desired.

Figure 2:
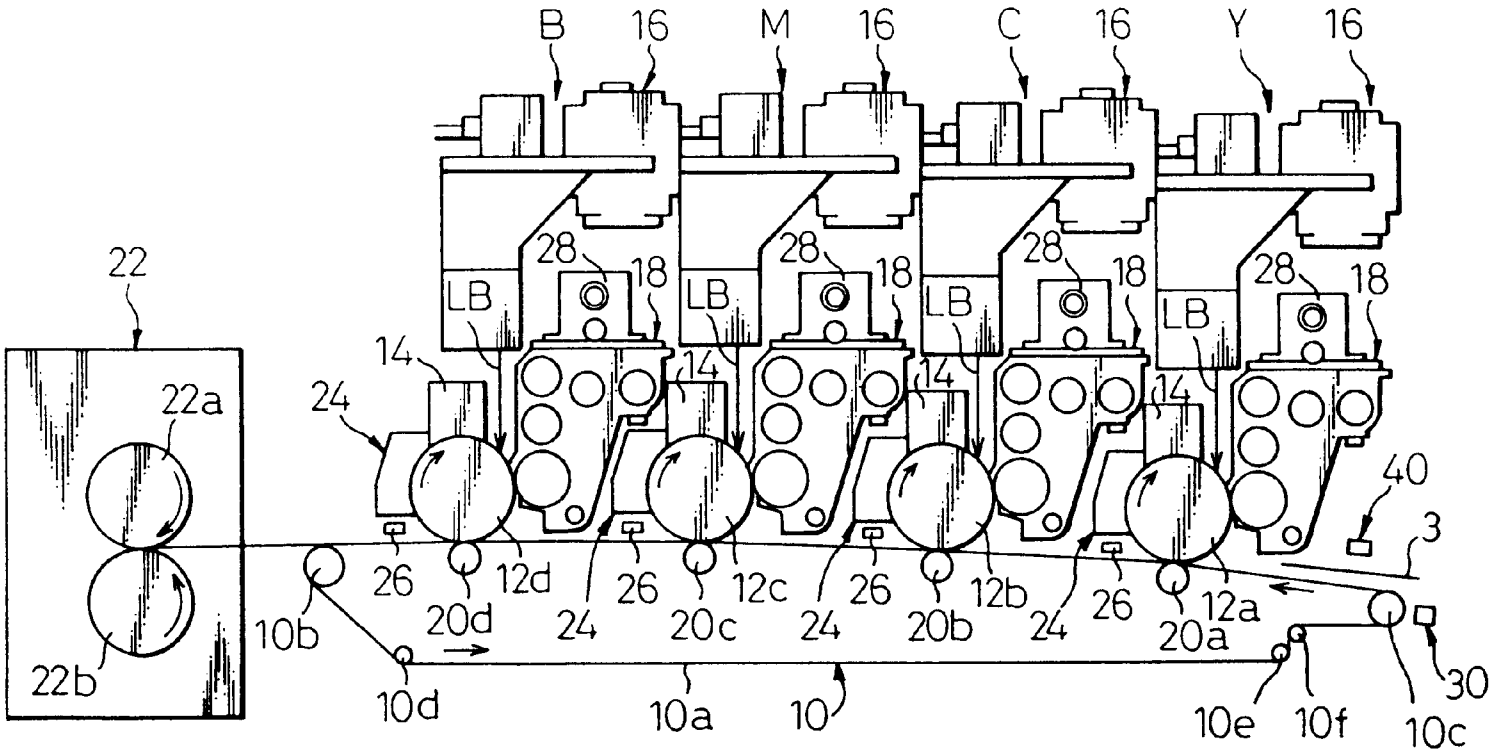
FIG. 2 is a schematic view of an electrostatic electronic recording apparatus using a dielectric belt according to the present invention.

Referring now to FIG. 2, there is shown a multi-color electrostatic recording apparatus according to one embodiment of the present invention which includes an endless transfer belt 10 for conveying a recording medium (sheet of paper).

Transfer belt 10 comprises an endless belt 10*a* made of a flexible dielectric material such as a suitable synthetic resin material, and this endless belt 10*a* is spread around a plurality of rollers 10*b* to 10*f*. The roller 10*b* functions as a driving roller, and the driving roller 10*b* drives the endless belt 10*a* by a suitable driving mechanism not shown in the drawing.

The roller 10*c* functions as a follower roller. Both of the rollers 10*d* and 10*e* function as the guide rollers, and are disposed in the proximity of the driving roller 10*b* and the follower roller 10*c*. The tension roller 10*f* is interposed between the follower roller 10*c* and the guide roller 10*e*, and applies a suitable tension to the endless belt 10*a*.

The upper driving portion of the endless belt 10*a*, that is, the driving portion defined between the driving roller 10*b* and the follower roller 10*c*, defines a paper moving path, and the sheet of paper 3 is introduced from the side of the follower roller 10*a* and is discharged from the side of the driving roller 10*b*. When introduced from the side of the follower roller 10*c*, the sheet of paper 3 is electrostatically attracted to the endless belt 10*a* due to electrification of the endless belt 10*a* as will be later described.

The multi-color electrostatic recording apparatus is equipped with four electrostatic recording units Y, C, M and B, and these electrostatic recording units are disposed in series from the upstream side to the downstream side along the upper travelling porion of the endless belt 10*a*. The electrostatic recording units Y, C, M and B have the same construction with one another, and record the toner images in yellow, cyan, magenta and black on the sheet of paper moving along the upper travelling portion of the endless belt 10*a*.

Each of the electrostatic recording units Y, C, M and B has an image carrying body, that is, a photoconductor drum 12 (12*a* to 12*d*), and each photoconductor drum 12 is driven for rotation in a direction indicated by an arrow at the time of the recording operation. A pre-electrifier 14 constituted as a corona charger or a scorotron charger is disposed above the photoconductor drum 12, and sequentially and uniformly electrifies the rotating surface of the photoconductor drum 12. An electrostatic latent image is written to the electrification area of the photoconductor drum 12 by optical write means 16 such as a laser beam LB emitted from a laser beam scanner. In other words, the laser beam LB is turned ON and OFF on the basis of digital image data obtained from a computer, a word processor, and the like, so that the electrostatic latent image is written as a dot image.

The electrostatic latent image written onto the photoconductors drum 12 is photo-electrostatically developed with a predetermined color toner as an electrified toner image by a developing device 18, which is disposed on the upstream side of the paper passage portion with respect to the photoconductor drum 12. The electrified toner image on the photoconductor drum 12*a* to 12*d* of each electrostatic recording unit Y, C, M, B is transferred electrostatically and sequentially to the sheet of paper 3 by a transfer electrifier disposed below each photoconductor drum 12, that is, a conductive transfer roller 20*a* to 20*d*.

The conductive transfer rollers 20*a* to 20*d* are opposed to the photoconductor drums 12*a* to 12*d*, respectively, through the upper travelling portion of the endless belt 10*a*, and apply the charge having an opposite polarity to that of the electrified toner image, so that the electrified toner image is electrostatically transferred from the photoconductor drums 20*a* to 20*d* to the sheet of paper 3. By the way, transfer by the conductive transfer rollers 20*a* to 20*d* will be described later in more detail.

According to the construction described above, when the sheet of paper 3 is introduced from the follower roller 10*c* of the transfer belt 10 and serially passes through the electrostatic recording units Y, C, M and B, the toner images of the four colors are superposed to thereby form a full color image.

Next, the sheet of paper is fed from the side of the driving roller 10*b* of the transfer belt 10 to a heat roller type heat fixing device 22, where the full color image is thermally fixed on the sheet of paper. In other words, the heat roller type heat fixing device 22 comprises a heat roller 22*a* and a backup roller 22*b*. During the printing operation, the heat roller 22*a* and the backup roller 22*b* are driven in the direction indicated by an arrow in FIG. 2. The sheet of paper discharged from the side of the driving roller 10*b* of the transfer belt 10 is carried between the nips of both rollers 22*a* and 22*b*. At this time, the transferred toner image on the surface of paper is thermally fused, so that the transferred toner image is thermally fixed on the sheet of paper.

On the other hand, in each of the electrostatic units Y, C, M and B, residual toner which is not transferred to the sheet of paper remains and adheres to the surface of the photoconductor drum 12 through the transfer process, but this residual toner is removed by a cleaner 24 disposed on the downstream side of the sheet moving path with respect to the photoconductor drum 12. Incidentally, reference numeral 26 denotes a light emitting member, such as a light emitting diode array, for removing the charge from the surface of the photoconductor drum 12 after the transferring process, and reference numeral 28 denotes a developer supplementing container for suitably supplementing the toner component to the developing device 28.

As will be described later, the present invention includes a first electrifying means 30 for applying a voltage to only the dielectric belt 10 at a stage before the sheet of paper 3 is attracted to the dielectric belt 10, and a second electrifying means 40 for applying the voltage to the sheet of paper 3 conveyed onto the dielectric belt and to the dielectric belt while they are mutually superposed.

Figure 3:
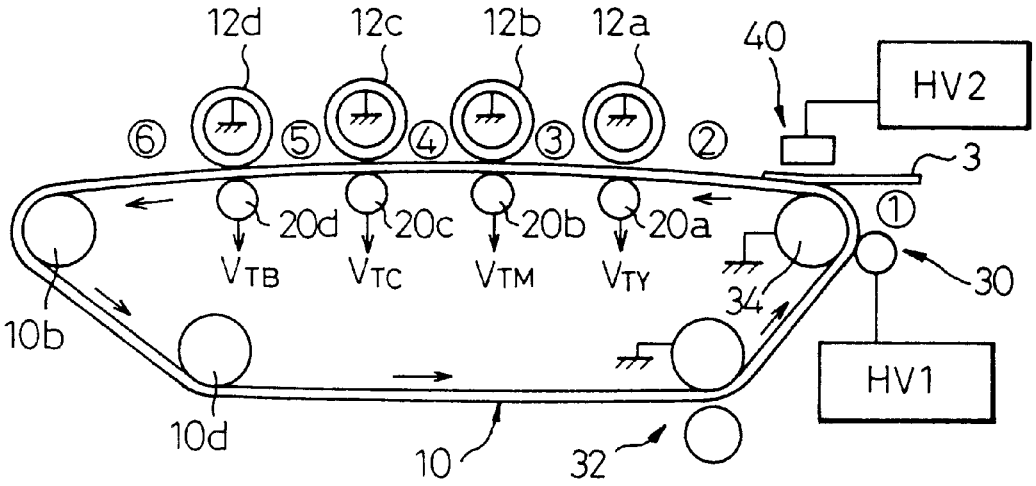
FIG. 3 is a schematic view showing a conveying and transfer portion of a sheet of paper by the dielectric belt according to the present invention.

FIG. 3 is a schematic view useful for explaining the conveying and transferring method of the sheet of paper by the dielectric transfer belt according to the present invention.

The dielectric transfer belt 10 for conveying the sheet of paper 3 and transferring the toner from the photoconductor drum 12 is rotated in the direction of the arrow by the driving roller 10*b*. The transfer belt 10 is provided with the electrifying means 30 and the electrifying means 40. By the way, the transfer belt 10 is dielectrified by an AC dielectrifier 32 as a prior process to the electrifying means 30.

The electrifying means 30 electrifies only the transfer belt 10 at the stage before the sheet of paper 3 is supplied to the transfer belt 10. The transfer voltage of the electrifying means 30 is $V_1$. On the other hand, the electrifying means 40 electrifies the transfer belt 30 while the sheet of paper 3 is held on the transfer belt 10 which is electrified by the electrifying means 30. The electrifying voltage of the transfer means 40 is $V_2$. Here, the sheet of paper 3 is electrostatically attracted to the transfer belt 10 and is then fed to the first photoconductor drum 12*a*.

These electrifying means 30 and 40 may be, as concrete constructions, sponge-like rollers, fixed brushes, rotary brushes, and so forth. The cleaning operation can be carried out on the dielectric belt 10 by making the peripheral speed of the rotary brush different from that of the dielectric belt.

By the way, the volume resistivity of the surface of the dielectric belt 10 is preferably at least $10^{13}$ ohm-cm, and the volume resistivity of the electrifying roller or the rotary brush is preferably $10^3$ to $10^7$ ohm-cm. In this case, suitable electrification is effected to the dielectric belt 10 under the transfer condition described above.

As shown in FIG. 3, the constructions of the electrifying means 30 and 40 can be simplified, since the electrifying means 30 and 40 are made as electrifying rollers, a common conductive roller 34 is disposed to oppose these two electrifying rollers while interposing the dielectric belt 10 between them, and the conductive roller 34 is connected to the ground.

As described above, the yellow, cyan, magenta and black toner images are developed on the surface of the photoconductor drums 12*a* to 12*d*, respectively, and when the transfer voltage is applied to each of the conductive transfer rollers 20*a* to 20*d*, each toner image is transferred to the sheet of paper 3. After passing through the four photoconductor drums 12*a* to 12*d*, the sheet of paper 3 is separated from the transfer belt 10 as described above, and is fed to the fixing device 22, where the toner is fused and solidified and is then fixed to the sheet of paper 3.

The transfer roller 20*d* used for the last photoconductor drum 12*d* is controlled in such a manner that the transfer voltage to only the distal end portion of the sheet of paper 3 is lowered when the black toner image is transferred from the last photoconductor drum 12*d* to the sheet of paper 3. Therefore, even if the cancelling electrifier 7 which has been used in the prior art example shown in FIG. 1 is not provided, the sheet of paper 3 can be smoothly separated from the dielectric belt 10 by the curved path by the driving roller 10*b* of the transfer belt 10 after the sheet of paper 3 passes through the last photoconductor drum 12*d*.

Figure 4:
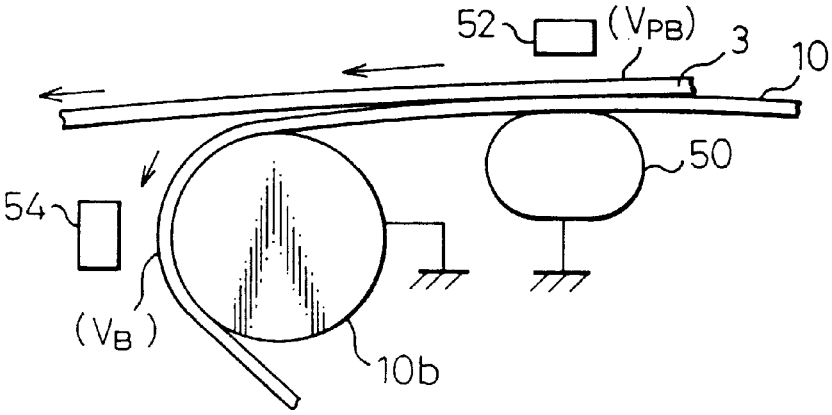
FIG. 4 is a schematic view useful for explaining a method of measuring the potentials of the sheet of paper and the transfer belt, and attraction force.

FIG. 4 is a schematic view useful for explaining the method of measuring the potential in the conveying/transferring apparatus of the sheet of paper whose outline is shown in FIG. 3. First, the method of measuring the potentials of the sheet of paper 3 and the transfer belt 10 will be explained.

A fixed electrode 50, which is connected to the ground, is disposed inside the transfer belt 10, and the transfer belt 10 and the sheet of paper 3 attracted to this transfer belt 10 are allowed to pass over this fixed electrode 50. A surface potential sensor 52 is disposed on the opposite side to the fixed electrode 50 in such a manner as to interpose the transfer belt 10 between them, and measures the surface potential $V_{TY}$ of the sheet of paper 3.

Next, a surface potential sensor 54 measures the potential $V_B$ of the transfer belt after the sheet of paper 3 is separated from the transfer belt 10. The paper potential $V_P$ after the sheet of paper 3 is separated from the transfer belt 10 is a value obtained by the following equation:

$$V_P = V_{PB} - V_B \tag{1}$$

Next, the paper attraction force acting between the sheet of paper 3 and the transfer belt 10 is measured by stopping the transfer belt 10 before the sheet of paper 3 separates from the transfer belt 10, pulling the sheet of paper 3 by a spring balance (not shown) in the paper conveying direction indicated by an arrow in the drawing and measuring the maximum load at the time when the sheet of paper 3 separates from the transfer belt 10.

Figure 5:
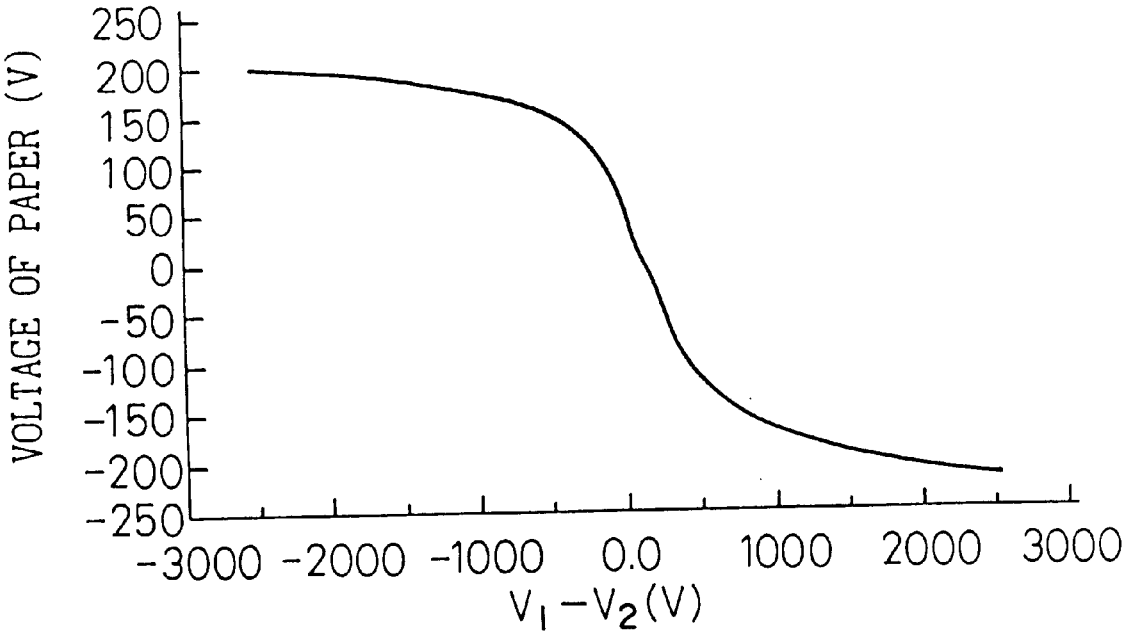
FIG. 5 is diagram showing the relationship between $V_2-V_1$ and a paper potential.

FIG. 5 shows the result of measurement of the potentials electrified by the electrifying means 30 and 40 at a position ahead of the first photoconductor drum 12 shown in FIG. 3 (position ③ of FIG. 3) and the paper potential by a method as explained above. In other words, the relationship between the difference ($V_1$–$V_2$) between the potential $V_1$ of the transfer belt 10 electrified by the electrifying means 30 and the potential $V_2$ on the sheet of paper 3 from the electrifying means 40, and the paper potential V at the position ② in FIG. 3 is such that when $V_1$ is lower than $V_2$, the sheet of paper 3 is electrified to a positive polarity, and when $V_1$ is higher than $V_2$, the sheet of paper 3 is electrified to a negative polarity.

Figure 6:
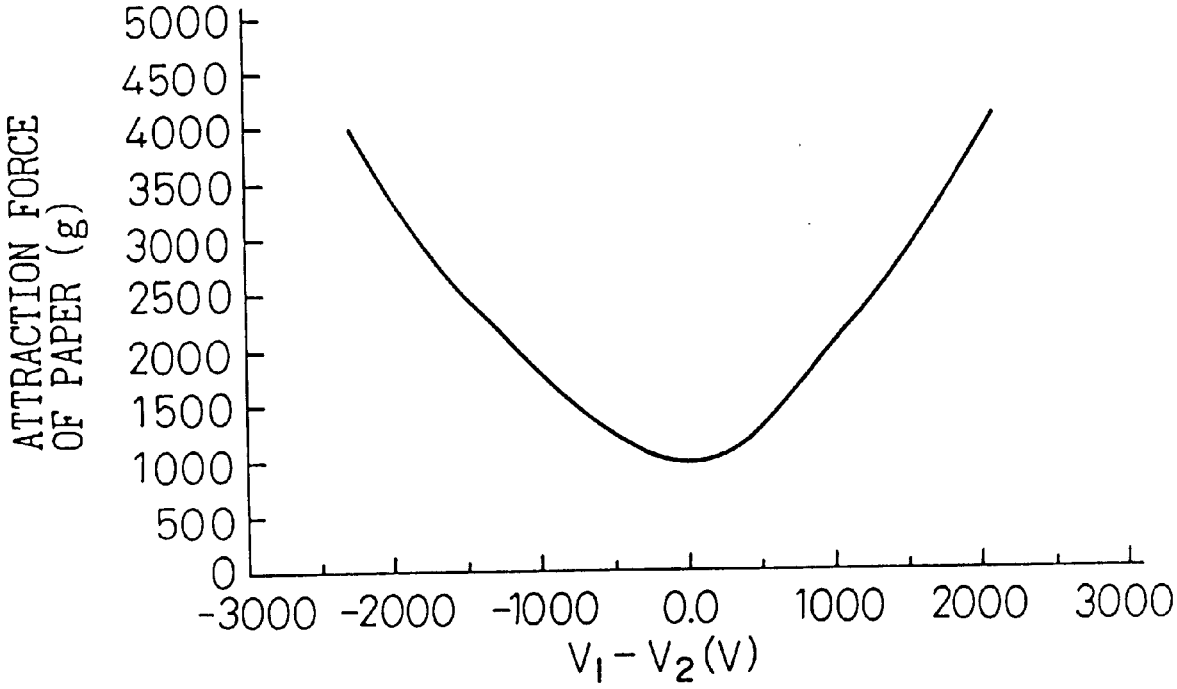
FIG. 6 is a diagram showing the relationship between $V_2-V_1$.

FIG. 6 shows the relationship between the potential difference ($V_1$–$V_2$) and the paper attraction force (g) by the transfer belt 10 at this time. The greater the potential difference, the greater becomes the paper attraction force irrespective of the polarity of the potential of the sheet of paper.

Figure 7:
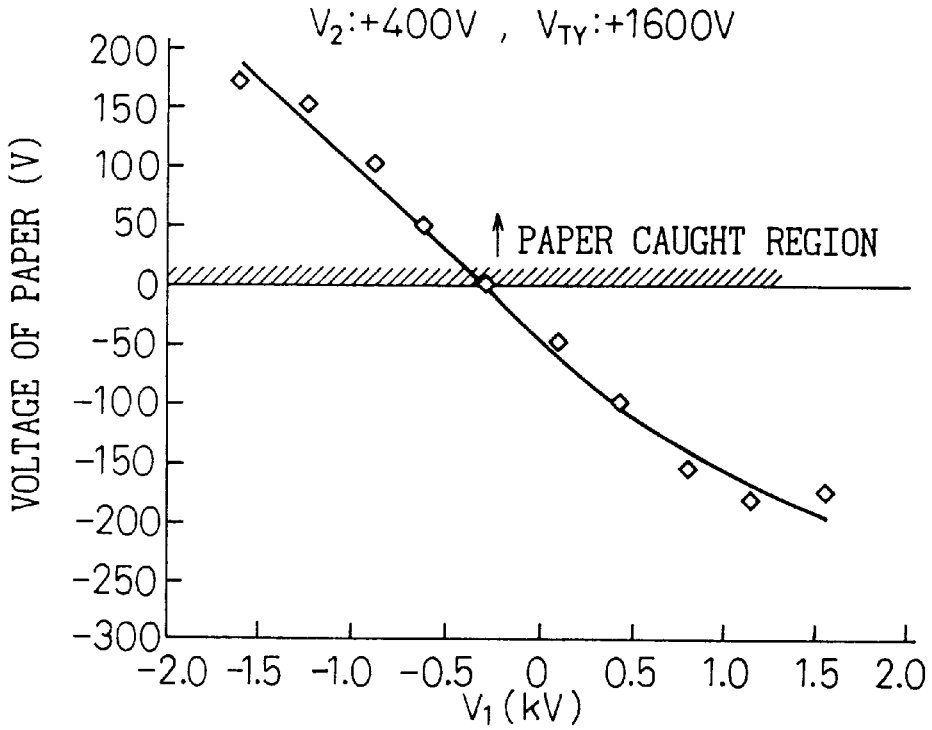
FIG. 7 is a diagram showing the relationship between a transfer voltage ($V_{TY}$) and a paper voltage.

Next, an explanation will now be given on the case where the sheet of paper 3 passes by the first photoconductor drum 12*a*. Here, the relationship of the potential is determined at the position (position ③) between the photoconductor drum 12*a* and the photoconductor drum 12*b* in FIG. 3, assuming that the surface of the photoconductor drum 12*a* has the negative charge (surface potential: −600V) and a positive voltage ($V_{TY}$) is applied to the transfer roller 20*a*. At this time, $V_2$ is kept constant at +400V, the transfer voltage $V_{TY}$ is kept constant at +1,600V, and $V_1$ is changed. If $V_1$ is increased, the paper voltage (V) at the position in FIG. 3 becomes lower. When the sheet of paper 3 is in the positive charge (when $V_1$ is lower than −0.3 kV), catching of the paper into the photoconductor drum 12*a* is likely to occur as indicated by "Paper Caught Region" in FIG. 7. This is because when the charge of the sheet of paper 3 has a positive charge, this positive charge mutually attracts the negative charge on the surface of the photoconductor drum 12*a* after transfer, and consequently, the sheet of paper 3 is wound on the photoconductor drum 12*a*.

Figure 8:
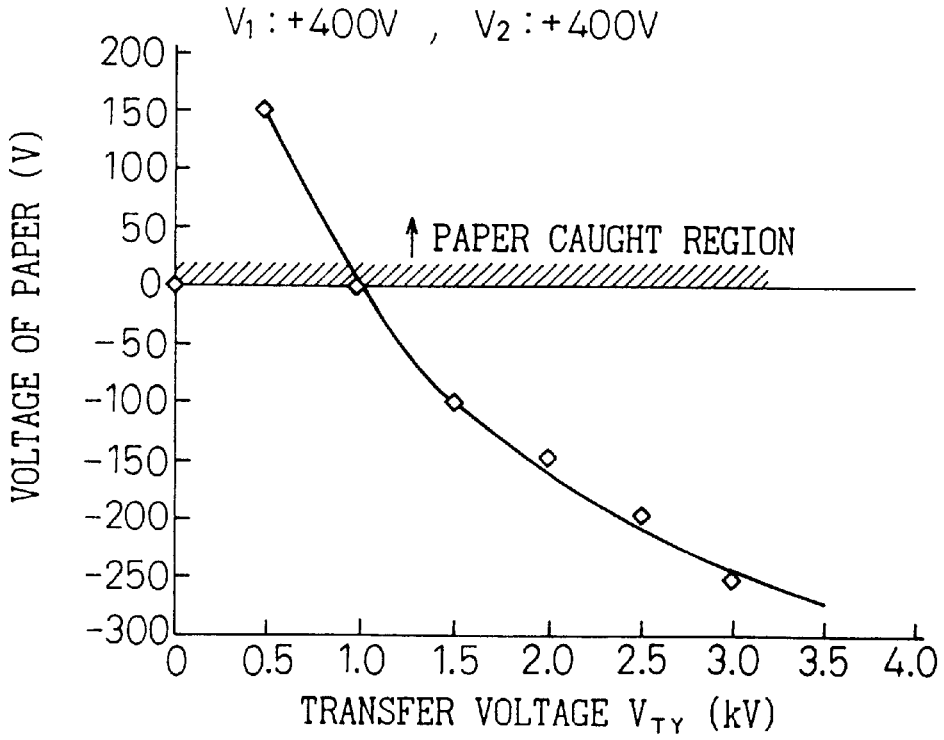
FIG. 8 is a diagram showing the relationship between a transfer voltage ($V_{TY}$) and the paper voltage.

The paper potential changes also with the value of the transfer voltage. FIG. 8 shows their relationship. Here, both of $V_1$ and $V_2$ are set to +400V and the transfer voltage ($V_{TY}$) given by the transfer roller 20*a* is changed from 0 to 3.5 KV. Catching of the sheet of paper on the photoconductor drum 12*a* occurs below the transfer voltage of 1.0 KV at which the paper potential becomes positive.

Therefore, in order to prevent this catching of the sheet of paper 3 on the photoconductor drum 12*a,* the relationship between $V_1$ and $V_2$ and also between the transfer voltage ($V_{TY}$) must be selected so that the potential of the sheet of paper which has just passed through the photoconductor drum has at least the same potential as that of the surface potential of the photoconductor drum 12*a*. If setting is preferably made by only the relationship between $V_1$ and $V_2$ so that the paper potential has the same polarity as that of the surface potential of the photoconductor drum 12*a,* catching of the sheet of paper to the photoconductor drum 12*a* does not occur. It has also been confirmed, by experiment, that, when setting is made so that the paper potential has the same polarity as that of the surface potential of the photoconductor drum 12*a,* or when the transfer belt 10 is electrified to +800V by the electrifying means 30 and the sheet of paper, to +400V by the electrifying means 40, catching of the sheet of paper 3 on the photoconductor drum 12*a* does not occur at a temperature and humidity of from 5° C. and 20% to 35° C. and 80%.

Figure 9:
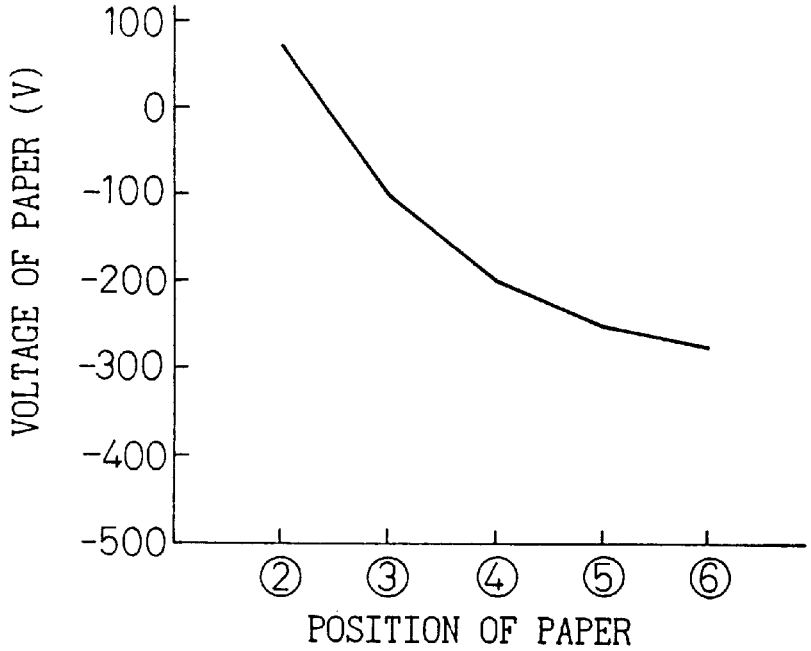
FIG. 9 is a diagram showing the relationship between the position of the sheet of paper on the transfer belt and the paper voltage.

The paper potentials, at the time when the sheet of paper passes through the second photoconductor drum 12*b,* the third photoconductor drum 12*c* and the fourth photoconductor drum 12*d,* becomes progressively higher with the same polarity as that of these photoconductor drums 12*b,* 12*c* and 12*d* due to the voltages of the respective transfer rollers 20*b,* 20*c* and 20*d*. More concretely, FIG. 9 shows the paper potentials at the position in front of the photoconductor drum 12*a* in FIG. 3 (position ②), the position between the photoconductor drums 12*a* and 12*b* (position ③), the position between the photoconductor drums 12*b* and 12*c* (position ④), the position between the photoconductor drums 12*a* and 12*b* (position ⑤) and the position at the back of the photoconductor drum 12*d* (position ⑥), respectively.

As explained above, catching of the sheet of paper on the photoconductor drum 12 can be prevented over a broad environmental range by electrifying the paper potential to the same polarity as that of the surface potential of the photoconductor drum.

Next, the relationship between the potential $V_2$ at the electrifying means 40 and the transfer voltage will now be explained.

When the relationship between $V_2$ and the transfer voltage $V_{TY}$ at which the toner transfer efficiency by the first photoconductor drum 12*a* becomes at least 85% was examined, it was found that $V_{TY}$ becomes lower when $V_2$ becomes higher and particularly when $V_2$ comes to have the opposite polarity to that of the photoconductor drum. That is, when $V_2$ becomes positive, $V_{TY}$ becomes even lower (FIG. 8 shows $V_{TY}$ when $V_2$ is +400V). This is, because the toner has the same polarity as that of the surface of the photoconductor drum, the toner is more likely to be transferred to the sheet of paper as it is attracted by the charge having the opposite polarity on the surface of the sheet of paper.

The voltage necessary for transfer is determined by the three factors, i.e., the transfer belt 10, the photoconductor drum (12*a*) and the toner. However, in the embodiment useful for explaining the present invention, it is assumed to be acquired from the following equation (2):

$$V_{TY}=2{,}000-V_2 \tag{2}$$

According to the equation given above, the transfer voltage $V_{TY}$ can be lowered by making $V_2$ higher. However, when $V_2$ exceeds 1,300 to 1,400V, the toner is attracted by the sheet of paper and scatters before it adheres to the photoconductor drum. Therefore, $V_2$ must be set below these voltages.

Figure 10:
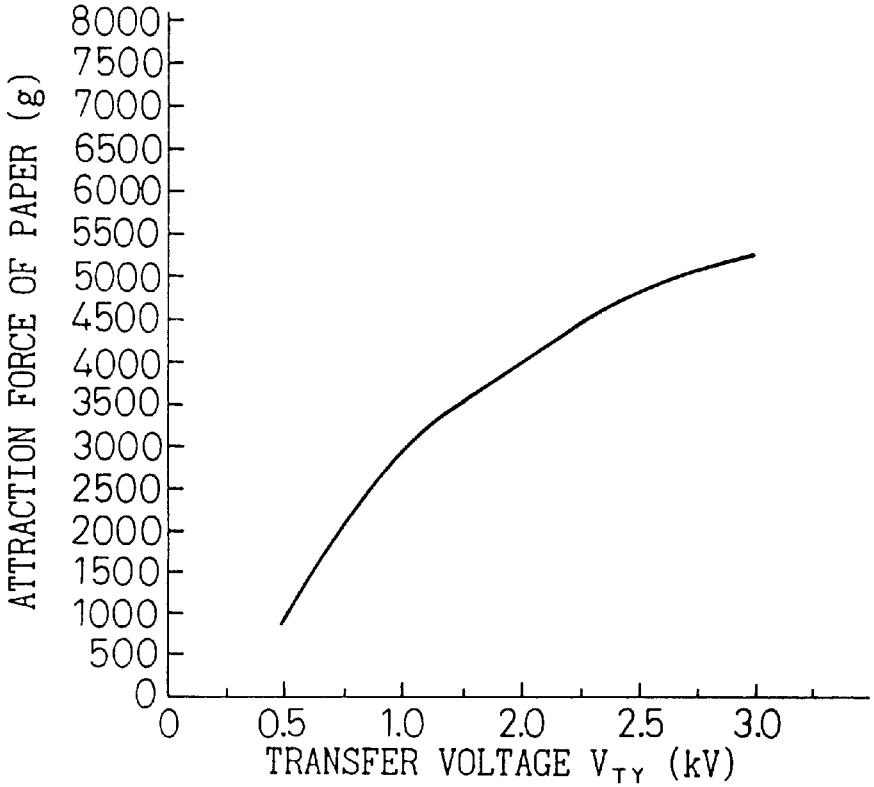
FIG. 10 is a diagram showing the relationship between the transfer voltage ($V_{TY}$) and the paper attraction force.

The relationship between the transfer voltage $V_{TY}$ and the paper potential is shown in FIG. 8, and the relationship between the transfer voltage $V_{TY}$ and the paper attraction force is shown in FIG. 10. As can be seen clearly from FIG. 8, when the transfer voltage $V_{TY}$ is made higher, the paper potential becomes also higher in the negative direction, and along therewith, the attraction force becomes stronger. This indicates that the higher the transfer voltage, the more difficult it becomes to separate the sheet of paper from the transfer belt. It can therefore be understood that the sheet of paper can be separated more easily by setting the potential $V_2$ of the electrifying means to a voltage as high as possible so as to lower the transfer voltage.

Figure 11:
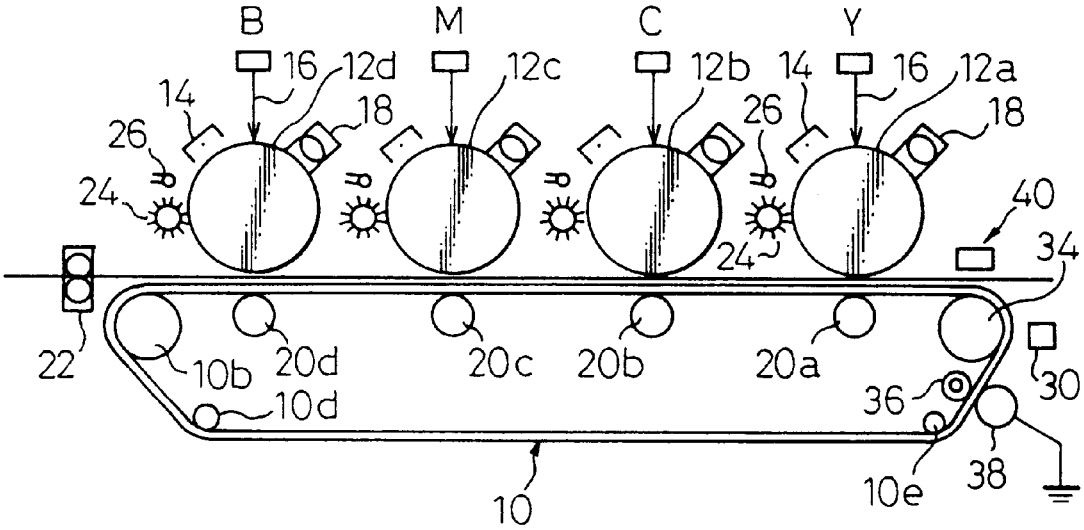
FIG. 11 is a schematic view showing an electrostatic electronic recording apparatus using a dielectric belt according to another embodiment of the present invention.

FIG. 11 is a schematic view showing another embodiment of the present invention, wherein same or corresponding reference numerals are used to identify same or corresponding constituent elements as in FIGS. 2 and 3, and the explanation of such elements is omitted. In this embodiment, a rotary brush cleaner 36 is provided immediately before the first electrifying means 30. A voltage is applied for deelectrifying the excessive charge accumulated in the dielectric belt 10. This rotary brush cleaner 36 is disposed in such a manner as to come into contact with the inside surface of the dielectric belt 10 opposite to the sheet conveying surface, and a conductive roller 38 which is grounded is so disposed as to oppose the rotary brush cleaner 36 while interposing the dielectric belt 10 between them.

A voltage for eliminating the excessive charge accumulated in the dielectric belt 10 is applied to this rotary brush cleaner 36. The polarity of this voltage is alternately changed for at least a predetermined time at the initial stage before the practical transfer operation is started. In this way, cleaning of the rotary brush cleaner 36 itself can be carried out.

Figure 12:
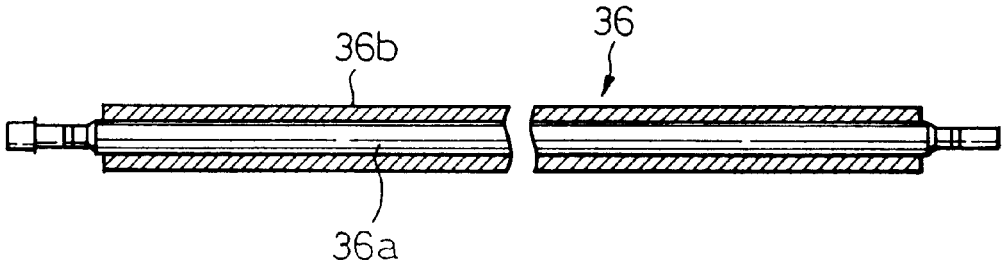
FIG. 12 is a schematic view showing a rotary brush cleaner used in the embodiment shown in FIG. 11.

FIG. 12 shows a preferred example of the rotary brush cleaner 36. Reference numeral 36*a* denotes a core portion, and reference numeral 36*b* denotes a conductive brush portion disposed around the core portion. This conductive brush portion 36*b* is greater than at least the width of the dielectric belt 10 and can deelectrify the entire width of the dielectric belt 10.

Figure 13:
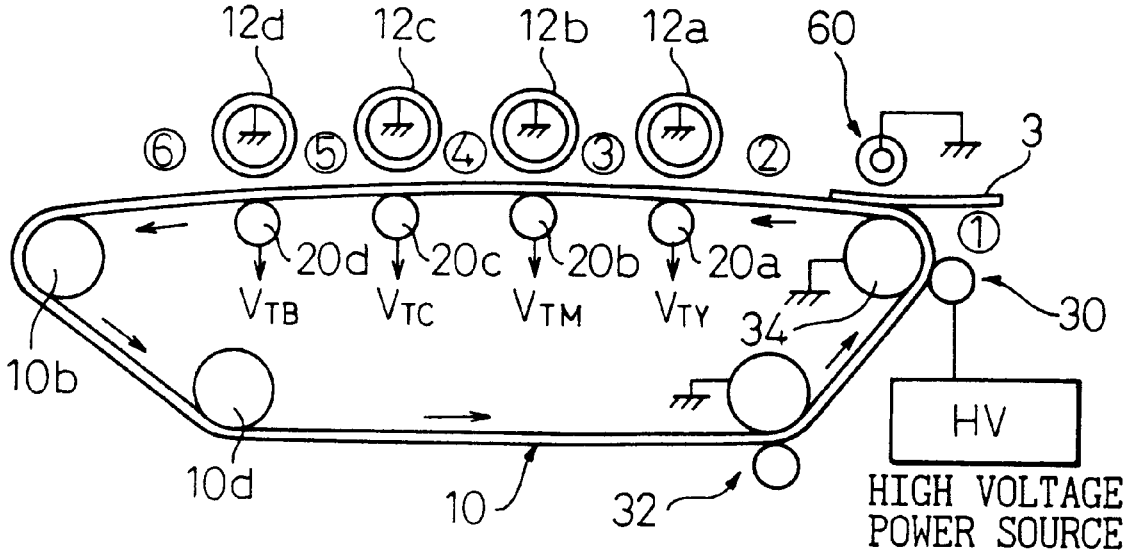
FIG. 13 is a schematic view showing an electrostatic electronic recording apparatus using a dielectric belt according to still another embodiment of the present invention.

FIG. 13 is a schematic view showing still another embodiment of the present invention, wherein the same or corresponding reference numerals are used to identify the same or corresponding constituent members as in FIGS. 2 and 3 and the explanation of such elements is omitted. The difference of this embodiment from the embodiment shown in FIG. 2 is that a conductive roller 60, a part of which is grounded, is disposed as means for electrostatically attracting the sheet of paper 3 to the dielectric belt 10 in place of the second electrifying means 40 in FIG. 2.

Figure 14:
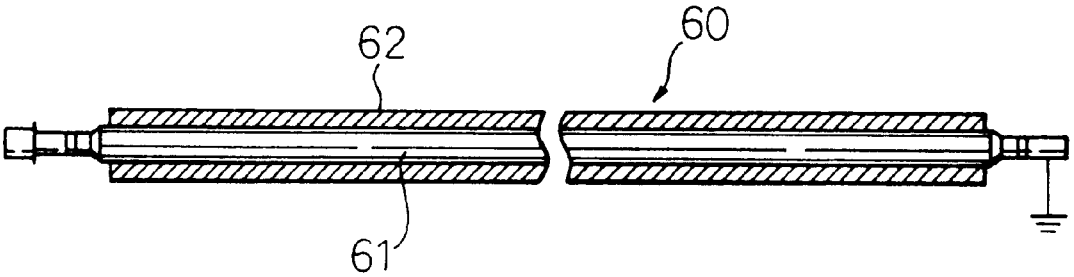
FIG. 14 is sectional view of a conductive roller used in the embodiment shown in FIG. 13.

As shown in FIG. 14, the conductive roller 60 comprises a conductive metal core 61 which is grounded, and a flexible member 62 such as a rubber or a porous sponge disposed around this metal core 61 and having electric resistance. The resistance value of the flexible member 62 is $10^3$ to $10^7$ ohms, the hardness is at least 20 degree in terms of JIS-A, and the frictional coefficient of the outer peripheral surface is preferably from 0.3 to 1.2. If the flexible member 62 is a rubber, it is possible to apply a known UV treatment or resin coating to the outer peripheral surface thereof and, in this way, the frictional coefficient can be adjusted to such a low value.

On the other hand, the electrifying means for applying the voltage to the dielectric belt 10 has fundamentally the same construction as the first electrifying means 30 shown is FIG. 2. In this embodiment, however, the absolute value of the voltage applied to the electrifying means 30 must be set to a higher voltage than the discharge start voltage by the conductive roller 60.

The electrifying means 30 may be constituted by a conductive stationary or rotary brush having a resistance value of $10^3$ to $10^7$ ohms or a roller-like conductive porous material rotating in the same direction as the sheet conveying direction by the dielectric belt 10.

The dielectric transfer belt 10 is rotated by the driving roller 10*b* in the direction indicated by an arrow in the drawing so as to convey the sheet of paper 3 and to transfer the toner from the photoconductor drums 12*a* to 12*d*. After dielectrified by the dielectrifying device 32, the dielectric belt 10 is electrified by the electrifying means 30. D.C. voltage or A.C. voltage is applied to this electrifying means 30. When the A.C. voltage is applied, a sine wave having a D.C. offset voltage or a rectangular wave is preferably used. The polarity of this offset voltage is opposite to the polarity of the surface potential of the photoconductor drums 12*a* to 12*d* as the image carrying body members.

Because the absolute value of the voltage applied to the electrifying means 30 is greater than the discharge start voltage by the conductive roller 60, discharge occurs from the side of the sheet of paper 3 to the metal core 61 grounded through the flexible member 62 of the conductive roller 60 simultaneously when the sheet of paper 3 is conveyed to the dielectric belt 10 which is electrified. In consequence, the sheet of paper 3 keeps a predetermined potential and moreover has a polarity opposite to the polarity of the potential applied to the electrifying means 30.

Accordingly, when the surface potential of the photoconductor drums 12*a* to 12*d* is negative, for example, electrification by the electrifying means 30 to the dielectric belt 10 is made positive, and the sheet of paper 3 can be thus electrified to be negative. When such polarities are used, the sheet of paper 3 and the photoconductor drums 12*a* to 12*d* repel one another, and catching of the sheet of paper 3 on the photoconductor drums 12*a* to 12*d* can be prevented. Since the potential of the dielectric belt 10 is positive in this case, the transfer voltage for transferring the sheet of paper 3 from the photoconductor drums 12*a* to 12*d* can be lowered.

When the conductive roller 60 which does not at all have any voltage application means but is merely grounded is disposed, catching of the sheet of paper 3 on the photoconductor drums 12*a* to 12*d* can be prevented, and the sheet of paper 3 can be stably conveyed on the dielectric belt 10. At the same time, the transfer voltage can be lowered, and the voltage for deelectrification by the corona discharge can also be lowered with the drop of the transfer voltage, and the generation of ozone due to the corona discharge can be restricted.

Incidentally, a felt-like dielectric belt cleaner which comes into contact with the dielectric belt 10 can be disposed in the proximity of the electrifying means 30 in the same way as in the embodiment shown in FIG. 11. In such a case, it is possible to constitute integrally the electrifying means 30 comprising the fixed brush, etc, and the felt-like cleaner, and to removably fit the integral assembly to the apparatus. It is naturally possible further to removably dispose a cleaner (not shown) for removing contamination of the surface of the rubber of the conductor roller 60 itself.

Figure 15:
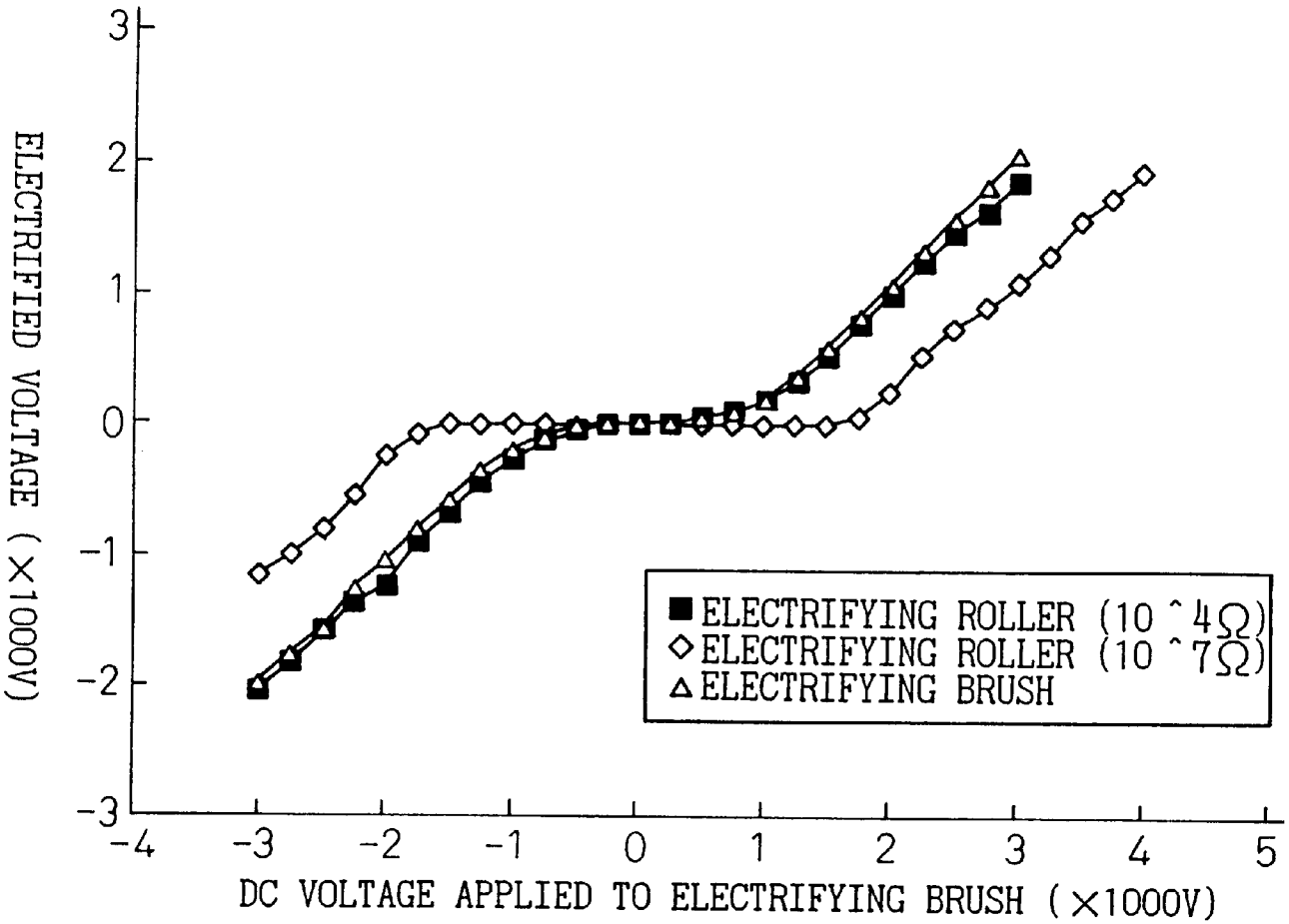
FIG. 15 is a diagram showing an electrified state of the dielectric belt immediately after electrification with respect to the applied voltage of electrifying means.

FIG. 15 shows the electrified state of the dielectric belt 10, immediately after being electrified, when the voltage applied to the electrifying means 30 is changed. If the electrifying means 30 is constituted by the electrifying roller ($10^{-4}$ ohms) (■), if it comprises the electrifying roller ($10^{-7}$ ohms) (◇), and if it comprises the electrifying brush (Δ), the respective electrified state is shown.

Figure 16:
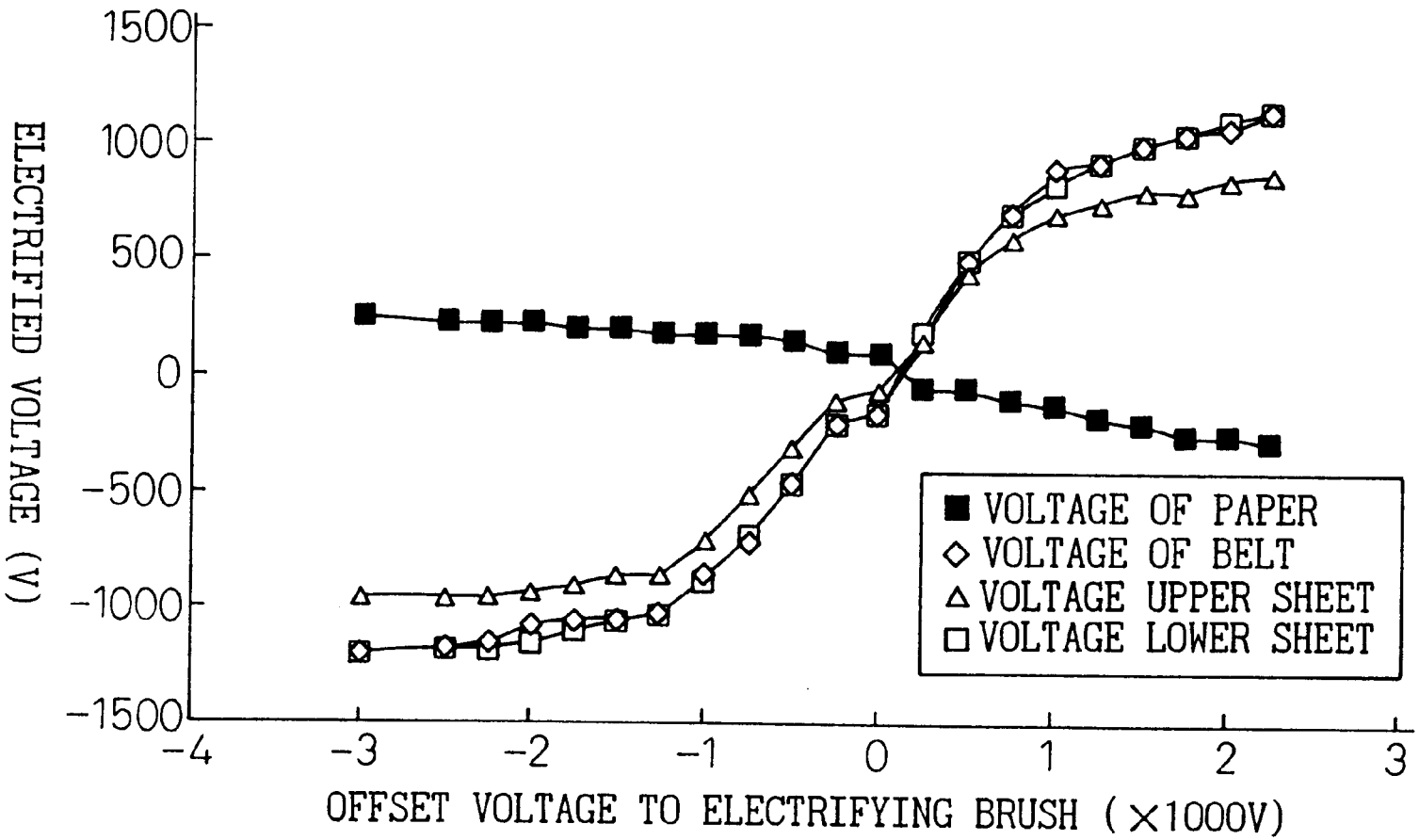
FIG. 16 is a diagram showing the electrified state of each portion with respect to the applied voltage of the electrifying means.

FIG. 16 shows the electrified state of each portion, in which the electrifying brush is used as the electrifying means 30, when the offset voltage applied to this electrifying brush is changed. The drawing shows the electrified voltage of the surface of the sheet of paper (■), the electrified voltage of the surface of the dielectric belt 10 immediately after being electrified (◇), the electrified voltage of the surface of the dielectric belt 10 on the upstream side of the sheet of paper (Δ), and the electrified voltage of the surface of the dielectric belt 10 on the downstream side of the sheet of paper (□). As shown in this diagram, it can be understood that the electrified voltage on the surface of the sheet of paper 3 has a polarity opposite to that of the impressed voltage to the electrifying means 30 by the corona discharge by the conductive roller 60.

As explained above, the present invention can suitably conduct the transfer of the toner image to the sheet of paper without catching of the sheet of paper by the photoconductor drum, can smoothly separate the sheet of paper from the dielectric belt, and can improve printing quality.

We claim:

1. An electrostatic recording system using a dielectric belt, comprising:

an image carrying body on a surface of which a toner image is developed;

a dielectric belt for conveying a sheet of paper while electrostatically attracting the same, and bringing said sheet of paper into contact with the surface of said image carrying body during conveying;

a transfer electrifier for applying a transfer voltage to said image carrying body from a side of said dielectric belt opposite said image carrying body, and transferring said toner image on the surface of said image carrying body to said sheet of paper;

first electrifying means for applying a first voltage to only said dielectric belt at a stage before said sheet of paper is attracted to said dielectric belt; and second electrifying means for applying a second voltage different from said first voltage to said sheet of paper conveyed to said dielectric belt, and to said dielectric belt, while said belt and said sheet of paper are superposed with each other, wherein both of said first and second electrifying means comprise electrifying rollers, and a common grounded conductive roller is disposed in such a manner as to oppose said two electrifying rollers while interposing said dielectric belt between them.

2. An electrostatic recording system according to claim 1, wherein said first and second electrifying means are controlled so that a potential of said sheet of paper immediately before it passes by said transfer electrifier has the same polarity as that of the potential on the surface of said image carrying body.

3. An electrostatic recording system according to claim 1, wherein, when a polarity of the potential of said sheet of paper immediately before it passes through said transfer electrifier is opposite to the polarity of the potential on the surface of said image carrying body, said first and second electrifying means and said transfer electrifier are controlled so that the paper potential immediately after passing through said transfer electrifier becomes the same polarity as that of the potential of the surface of said image carrying body.

4. An electrostatic recording system according to claim 1, wherein at least one of said electrifying rollers is pressed to, and brought into contact with, said dielectric belt, and freely rotates due to the movement of said dielectric belt while following the movement.

5. An electrostatic recording system according to claim 1, wherein at least said first electrifying means is disposed so as to come into contact with said dielectric belt.

6. An electrostatic recording system according to claim 1, wherein a volume resistivity of said dielectric belt is at least $10^{13}$ ohm-cm.

7. An electrostatic recording system according to claim 1, wherein a volume resistivity of said electrifying rollers is $10^3$ to $10^7$ ohm-cm.

8. An electrostatic recording system according to claim 1, wherein said second voltage is less than said first voltage.

9. An electrostatic recording system using a dielectric belt, comprising:

a plurality of image carrying bodies on a surface of which toner images are developed;

a dielectric belt for electrostatically attracting a sheet of paper, conveying it, and sequentially bringing said sheet of paper into contact with the surfaces of said plurality of image carrying bodies;

a plurality of transfer electrodes for applying transfer voltages to said plurality of image carrying bodies from a side of said dielectric belt opposite to said image carrying bodies, respectively, and sequentially transferring said toner images on the surfaces of said plurality of image carrying bodies to said sheet of paper;

first electrifying means for applying a first voltage to only said dielectric belt at a stage before said sheet of paper is attracted to said dielectric belt; and second electrifying means for applying second voltages different than said first voltage to said sheet of paper and said dielectric belt while said sheet of paper and belt are superposed with each other before said sheet of paper conveyed to said dielectric belt moves to a first of said plurality of image carrying bodies, wherein said transfer electrode corresponding to a last one of said plurality of image carrying bodies is controlled in such a manner as to lower a transfer voltage of only the distal end portion of said sheet of paper when said toner image is transferred from the last one of said plurality of image carrying bodies to said sheet of paper.

10. An electrostatic recording system according to claim 9, wherein four image carrying bodies are arranged in parallel to each other, so that yellow, magenta, cyan and black toners are sequentially supplied to said plurality of image carrying bodies, respectively, and toner images of these colors are developed on the surfaces of said plurality of image carrying bodies and are sequentially transferred to said sheet of paper.

11. An electrostatic recording system according to claim 9, wherein, when a potential of said sheet of paper immediately before it passes through said transfer electrifier has the same polarity as that of the potential on the surface of corresponding one of said plurality of image carrying bodies or is an opposite polarity, said first and second electrifying means and each of said transfer electrifiers are controlled so that a potential of said sheet of paper immediately after it passes through said transfer electrifier has the same polarity as that of the surface of said image carrying body.

12. An electrostatic recording system according to claim 9, wherein each of said second voltages is less than said first voltage.

13. An electrostatic recording system using a dielectric belt, comprising:

an image carrying body on a surface of which a toner image is developed;

a dielectric belt for conveying a sheet of paper while electrostatically attracting the same, and bringing said sheet of paper into contact with the surface of said image carrying body during conveying;

a transfer electrifier for applying a transfer voltage to said image carrying body from a side of said dielectric belt opposite said image carrying body, and transferring said toner image on the surface of said image carrying body to said sheet of paper;

first electrifying means for applying a first voltage to only said dielectric belt at a stage before said sheet of paper is attracted to said dielectric belt; and second electrifying means for applying a second voltage different from said first voltage to said sheet of paper conveyed to said dielectric belt, and to said dielectric belt, while said belt and said sheet of paper are superposed with each other, wherein at least one of said first and second electrifying means comprises an electrifying roller, and wherein at least a surface of said electrifying roller comprises a porous body.

14. An electrostatic recording system using a dielectric belt, comprising:

an image carrying body on a surface of which a toner image is developed;

a dielectric belt for conveying a sheet of paper while electrostatically attracting the same, and bringing said sheet of paper into contact with the surface of said image carrying body during conveying;

a transfer electrifier for applying a transfer voltage to said image carrying body from a side of said dielectric belt opposite said image carrying body, and transferring said toner image on the surface of said image carrying body to said sheet of paper;

first electrifying means for applying a first voltage to only said dielectric belt at a stage before said sheet of paper is attracted to said dielectric belt; and second electrifying means for applying a second voltage different from said first voltage to said sheet of paper conveyed to said dielectric belt, and to said dielectric belt, while said belt and said sheet of paper are superposed with each other, wherein at least said first electrifying means is disposed so as to come into contact with said dielectric belt, and wherein at least said first electrifying means comprises a rotary brush whose rotating surface comes into contact with said dielectric belt.

15. An electrostatic recording system according to claim 14, wherein a peripheral speed of said rotary brush differs from a peripheral speed of said image carrying body.

16. An electrostatic recording system according to claim 14, wherein a volume resistivity of said rotary brush is $10^3$ to $10^7$ ohm-cm.

17. An electrostatic recording system using a dielectric belt, comprising:

an image carrying body on a surface of which a toner image is developed;

a dielectric belt for conveying a sheet of paper while electrostatically attracting the same, and bringing said sheet of paper into contact with the surface of said image carrying body during conveying;

a transfer electrifier for applying a transfer voltage to said image carrying body from a side of said dielectric belt opposite said image carrying body, and transferring said toner image on the surface of said image carrying body to said sheet of paper;

first electrifying means for applying a first voltage to only said dielectric belt at a stage before said sheet of paper is attracted to said dielectric belt; and second electrifying means for applying a second voltage different from said first voltage to said sheet of paper conveyed to said dielectric belt, and to said dielectric belt, while said belt and said sheet of paper are superposed with each other, wherein a rotary brush cleaner for keeping a predetermined voltage to remove excessive charge accumulated in said dielectric belt is disposed immediately before said first electrifying means.

18. An electrostatic recording system according to claim 17, wherein said rotary brush cleaner is disposed in such a manner as to come into contact with an inside surface of said dielectric belt, i.e., on a side opposite to a paper conveying surface of said dielectric belt.

19. An electrostatic recording system according to claim 17, wherein a polarity of a voltage applied to said rotary brush cleaner is alternately changed for at least a predetermined time at an initial stage before an actual transfer operation is started.

20. An electrostatic recording system including:

an image carrying body on a surface of which a toner image is developed;

a dielectric transfer belt for electrostatically attracting a sheet of paper, conveying said sheet of paper and bringing said sheet of paper into contact with a surface of said image carrying body while it is conveyed;

a transfer electrifier for applying a transfer voltage to said image carrying body from a side of said dielectric belt opposite to said image carrying body, and transferring the toner image on the surface of said image carrying body to said sheet of paper;

electrifying means for applying a voltage to said dielectric belt at a stage before said sheet of paper is attracted to said dielectric belt; and means for electrostatically attracting said sheet of paper to said dielectric belt so electrified;

wherein said paper electrostatic attraction means comprises a conductive roller which has a peripheral portion coming into contact with a surface of said sheet of paper conveyed to said dielectric belt on an opposite side to said dielectric belt, and a part of said conductive roller is grounded, and an absolute value of a voltage applied to said electrifying means is higher than a discharge start voltage by said conductive roller.

21. An electrostatic recording system according to claim 20, wherein said conductive roller comprises a grounded conductive metal core, and a flexible member disposed around said metal core and having an electric resistance.

22. An electrostatic recording system according to claim 21, wherein an electrical resistance value of said flexible member is $10^3$ to $10^7$ ohm-cm.

23. An electrostatic recording system according to claim 21, wherein a hardness of said flexible member is at least 20 degree by JIS-A.

24. An electrostatic recording system according to claim 21, wherein said flexible member comprises a rubber having a frictional coefficient of 0.3 to 1.2.

25. An electrostatic recording system according to claim 24, wherein UV treatment or resin coating is applied to a surface of said rubber so as to lower the frictional coefficient of a surface of the rubber.

26. An electrostatic recording system according to claim 21, wherein said flexible member is a porous sponge.

27. An electrostatic recording system according to claim 21, wherein said electrifying means for applying a voltage to said dielectric belt is a conductive fixed brush or rotary brush having a resistance value of $10^3$ to $10^7$ ohms.

28. An electrostatic recording system according to claim 27, wherein a felt-like dielectric belt cleaning device coming into contact with said dielectric belt is disposed adjacent to said fixed brush or said rotary brush.

29. An electrostatic recording system according to claim 27, wherein said electrifying means is a rotary brush rotating in an opposite direction to a paper conveying direction with respect to said dielectric belt.

30. An electrostatic recording system according to claim 21, wherein said electrifying means for applying a voltage to said dielectric belt comprises a conductive porous material and has a roller shape, and rotates in the same direction as the paper conveying direction with respect to said dielectric belt.

31. An electrostatic recording system according to claim 21, wherein an A.C. voltage is applied to said electrifying means for applying a voltage to said dielectric belt and said A.C. voltage is a sine wave or rectangular wave having a D.C. offset voltage.

32. An electrostatic recording system according to claim 31, wherein the polarity of said offset voltage is opposite to the polarity of a surface potential of said image carrying body.

* * * * *